US007375072B2

(12) United States Patent
Penninger

(10) Patent No.: US 7,375,072 B2
(45) Date of Patent: May 20, 2008

(54) BLEACH-CONTAINING LAUNDRY DETERGENTS OR CLEANING COMPOSITIONS COMPRISING WATER-SOLUBLE BUILDER SYSTEM AND SOIL RELEASE-CAPABLE CELLULOSE DERIVATIVE

(75) Inventor: Josef Penninger, Hilden (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 27 days.

(21) Appl. No.: 11/200,679

(22) Filed: Aug. 10, 2005

(65) Prior Publication Data

US 2006/0035801 A1 Feb. 16, 2006

Related U.S. Application Data

(63) Continuation of application No. PCT/EP2004/000875, filed on Jan. 31, 2004.

(30) Foreign Application Priority Data

Feb. 10, 2003 (DE) ..... 103 05 306
Oct. 31, 2003 (DE) ..... 103 51 326

(51) Int. Cl.
*C11D 3/395* (2006.01)
*C11D 3/06* (2006.01)
*C11D 3/08* (2006.01)
*C11D 3/10* (2006.01)

(52) U.S. Cl. ..... 510/478; 510/276; 510/299; 510/318; 510/359; 510/361; 510/398; 510/400; 510/443; 510/453; 510/436; 510/460; 510/477; 510/509; 510/510; 510/511; 510/512; 510/531; 510/534; 510/302; 510/309; 510/310; 510/372; 510/375; 510/379

(58) Field of Classification Search ..... 510/276, 510/299, 318, 359, 361, 398, 400, 443, 453, 510/436, 460, 478, 477, 509, 510, 511, 512, 510/531, 534, 302, 309, 310, 372, 375, 379
See application file for complete search history.

(56) References Cited

U.S. PATENT DOCUMENTS 1,985,424 A 12/1934 Piggott
2,016,962 A 10/1935 Flint
2,703,798 A 3/1955 Schwartz
2,886,533 A 5/1959 Bacon
3,122,417 A 2/1964 Blaser
3,144,412 A 8/1964 Inamorato
3,380,850 A 4/1968 Jones
3,523,088 A 8/1970 Dean
3,547,828 A 12/1970 Mansfield
3,623,956 A 11/1971 Kalabokias
3,623,957 A 11/1971 Feldman
3,748,233 A 7/1973 Viccaro
3,985,923 A 10/1976 Basadur
4,000,093 A 12/1976 Nicol
4,116,885 A 9/1978 Derstadt
4,127,423 A 11/1978 Rankin
4,136,038 A 1/1979 Pracht
4,174,305 A 11/1979 Burns
4,192,761 A 3/1980 Peltre
4,240,918 A 12/1980 Lagasse
4,264,738 A 4/1981 Stepanov
4,372,868 A 2/1983 Saran
4,421,666 A 12/1983 Hempel
4,435,307 A 3/1984 Barbesgaard
4,443,355 A 4/1984 Murata
4,526,698 A * 7/1985 Kuroda et al. ..... 510/305
4,585,642 A 4/1986 Rieck
4,590,237 A 5/1986 Wuhrmann
4,732,693 A 3/1988 Hight (Continued)

FOREIGN PATENT DOCUMENTS

CA 2053900 10/1990

(Continued)

OTHER PUBLICATIONS

Staudinger, H., et al. (1938): "Über Molekulargewichtsbestimmung an Celluloseethern" in Liebigs Annalen der Chemie. 535, pp. 47-100.

(Continued)

*Primary Examiner*—Charles Boyer
(74) *Attorney, Agent, or Firm*—John E. Drach

(57) ABSTRACT

A builder-containing laundry detergent or cleaning composition is comprised of: (1) alkali metal percarbonate; (2) a water-soluble builder block which comprised of:
a) from 5% by weight to 35% by weight of citric acid, an alkali metal citrate, an alkali metal carbonate, and/or an alkali metal hydrogen carbonate,
b) up to 10% by weight of alkali metal silicate having a modulus in the range from 1.8 to 2.5,
c) up to 2% by weight of phosphonic acid and/or alkali metal phosphate,
d) up to 50% by weight of alkali metal phosphate, and
e) up to 10% by weight of polymeric polycarboxylate,
wherein at least two of components b), c), d) and e) are present in amounts greater than 0% by weight, and (3) a soil release-capable alkyl or hydroxyalkyl cellulose derivative. The soil release-capable action of cellulose derivatives is particularly marked when they are used in laundry detergents or cleaning compositions which comprise alkali metal percarbonates and contain only water-soluble builders.

24 Claims, No Drawings

U.S. PATENT DOCUMENTS

| | | | | | |
|---|---|---|---|---|---|
| 4,755,319 | A | | 7/1988 | Smolka | |
| 4,770,666 | A | | 9/1988 | Clauss | |
| 4,820,439 | A | | 4/1989 | Rieck | |
| 4,832,866 | A | | 5/1989 | Schulz | |
| 4,865,774 | A | | 9/1989 | Fabry | |
| 5,002,695 | A | | 3/1991 | Schulz | |
| 5,049,302 | A | | 9/1991 | Holland | |
| 5,138,046 | A | | 8/1992 | Wuest | |
| 5,183,651 | A | | 2/1993 | Schimmel | |
| 5,236,682 | A | | 8/1993 | Schimmel | |
| 5,240,851 | A | | 8/1993 | Paridans | |
| 5,268,156 | A | | 12/1993 | Schimmel | |
| 5,308,596 | A | | 5/1994 | Kotzian | |
| 5,332,518 | A | * | 7/1994 | Kuroda et al. | 510/309 |
| 5,356,607 | A | | 10/1994 | Just | |
| 5,374,716 | A | | 12/1994 | Biermann | |
| 5,405,412 | A | * | 4/1995 | Willey et al. | 8/111 |
| 5,411,673 | A | * | 5/1995 | Agar et al. | 510/312 |
| 5,427,936 | A | | 6/1995 | Moeller | |
| 5,443,750 | A | * | 8/1995 | Convents et al. | 510/322 |
| 5,445,755 | A | * | 8/1995 | Convents et al. | 510/305 |
| 5,460,747 | A | * | 10/1995 | Gosselink et al. | 510/220 |
| 5,482,642 | A | * | 1/1996 | Agar et al. | 510/315 |
| 5,501,814 | A | | 3/1996 | Engelskirchen | |
| 5,541,316 | A | | 7/1996 | Engelskirchen | |
| 5,576,282 | A | * | 11/1996 | Miracle et al. | 510/276 |
| 5,576,425 | A | | 11/1996 | Hill | |
| 5,700,771 | A | * | 12/1997 | Hardy et al. | 510/315 |
| 5,705,466 | A | * | 1/1998 | Baillely et al. | 510/312 |
| 5,718,891 | A | | 2/1998 | Prat | |
| 5,786,316 | A | * | 7/1998 | Baeck et al. | 510/235 |
| 5,830,956 | A | | 11/1998 | Stockhausen | |
| 5,837,666 | A | * | 11/1998 | Murata et al. | 510/299 |
| 5,854,321 | A | | 12/1998 | Krause | |
| 5,902,682 | A | | 5/1999 | Bertsch-Frank | |
| 5,916,481 | A | * | 6/1999 | Willey | 252/186.21 |
| 5,919,271 | A | * | 7/1999 | Baillely et al. | 8/137 |
| 5,948,744 | A | | 9/1999 | Baillely | |
| 6,204,234 | B1 | * | 3/2001 | Herbots et al. | 510/321 |
| 6,218,351 | B1 | * | 4/2001 | Busch et al. | 510/311 |
| 6,221,824 | B1 | | 4/2001 | Lietzmann | |
| 6,221,832 | B1 | * | 4/2001 | Casteel et al. | 510/446 |
| 6,242,403 | B1 | * | 6/2001 | Lammers et al. | 510/294 |
| 6,242,406 | B1 | * | 6/2001 | Katsuda et al. | 510/357 |
| 6,248,708 | B1 | * | 6/2001 | Merz et al. | 510/404 |
| 6,267,934 | B1 | | 7/2001 | Pardini | |
| 6,380,145 | B1 | * | 4/2002 | Herbots et al. | 510/392 |
| 6,407,055 | B1 | * | 6/2002 | Bauer et al. | 510/511 |
| 6,444,634 | B1 | * | 9/2002 | Mason et al. | 510/376 |
| 6,462,008 | B1 | * | 10/2002 | Ortiz et al. | 510/301 |
| 6,881,359 | B2 | * | 4/2005 | Leeners et al. | 264/9 |
| 6,891,034 | B2 | | 5/2005 | Dannhorn | |
| 2002/0042354 | A1 | | 4/2002 | Lang | |
| 2003/0060390 | A1 | | 3/2003 | Demeyere | |
| 2003/0166484 | A1 | | 9/2003 | Kingma | |
| 2004/0067862 | A1 | | 4/2004 | Speckmann | |
| 2004/0067863 | A1 | | 4/2004 | Speckmann | |
| 2006/0030504 | A1 | | 2/2006 | Penninger | |
| 2006/0035804 | A1 | | 2/2006 | Penninger | |
| 2006/0035805 | A1 | | 2/2006 | Penninger | |
| 2006/0035806 | A1 | | 2/2006 | Penninger | |
| 2006/0046950 | A1 | | 3/2006 | Penninger | |
| 2006/0046951 | A1 | | 3/2006 | Penninger | |

FOREIGN PATENT DOCUMENTS

| | | | |
|---|---|---|---|
| CA | 2299437 | | 8/2000 |
| CA | 2315341 | | 2/2001 |
| DE | 255884 | | 1/1913 |
| DE | 11 07 207 | | 5/1961 |
| DE | 1 940 488 | | 2/1971 |
| DE | 2 044 161 | | 4/1971 |
| DE | 2101 803 | | 7/1971 |
| DE | 1 617 141 | | 4/1972 |
| DE | 2 121 397 | | 11/1972 |
| DE | 2 253 063 | | 5/1973 |
| DE | 2 200 911 | | 10/1973 |
| DE | 24 12 837 | C3 | 10/1974 |
| DE | 26 32 218 | | 1/1977 |
| DE | 26 55 551 | | 6/1977 |
| DE | 28 46 984 | | 5/1979 |
| DE | 28 57 292 | C2 | 2/1980 |
| DE | 31 17 250 | C2 | 4/1982 |
| DE | 32 07 825 | C2 | 9/1982 |
| DE | 32 07 847 | A1 | 9/1982 |
| DE | 31 15 644 | A1 | 11/1982 |
| DE | 33 22 950 | | 1/1984 |
| DE | 33 24 258 | A1 | 1/1984 |
| DE | 34 00 008 | A1 | 7/1985 |
| DE | 34 36 194 | C2 | 4/1986 |
| DE | 28 57 155 | C3 | 2/1991 |
| DE | 42 21 381 | C1 | 2/1994 |
| DE | 43 08 794 | C1 | 4/1994 |
| DE | 43 00 772 | C2 | 7/1994 |
| DE | 43 23 410 | A1 | 1/1995 |
| DE | 43 26 653 | | 2/1995 |
| DE | 195 04 006 | | 8/1996 |
| DE | 196 20 249 | A1 | 11/1997 |
| DE | 197 28 390 | A1 | 1/1999 |
| DE | 199 12 679 | | 6/2000 |
| DE | 199 36 612 | | 2/2001 |
| DE | 100 37 126 | A1 | 2/2002 |
| DE | 100 38 978 | | 2/2002 |
| EP | 0 006 638 | B1 | 1/1980 |
| EP | 0 028 865 | | 5/1981 |
| EP | 0 037 026 | B1 | 10/1981 |
| EP | 0 066 944 | B1 | 12/1982 |
| EP | 0 075 433 | B1 | 3/1983 |
| EP | 0 080 223 | B1 | 6/1983 |
| EP | 0 080 748 | B1 | 6/1983 |
| EP | 0 087 233 | B1 | 8/1983 |
| EP | 0 092 355 | A1 | 10/1983 |
| EP | 0 094 250 | B2 | 11/1983 |
| EP | 0 100 125 | B1 | 2/1984 |
| EP | 0 117 553 | A2 | 9/1984 |
| EP | 0 130 064 | B1 | 1/1985 |
| EP | 0 133 566 | | 2/1985 |
| EP | 0 150 386 | B1 | 8/1985 |
| EP | 0 164 514 | B1 | 12/1985 |
| EP | 0 164 552 | B1 | 12/1985 |
| EP | 0 167 309 | B1 | 1/1986 |
| EP | 0 185 427 | B1 | 6/1986 |
| EP | 0 204 284 | A2 | 12/1986 |
| EP | 0 213 729 | B1 | 3/1987 |
| EP | 0 213 730 | B1 | 3/1987 |
| EP | 0 214 761 | B1 | 3/1987 |
| EP | 0 218 272 | B1 | 4/1987 |
| EP | 0 241 984 | B1 | 10/1987 |
| EP | 0 241 985 | B1 | 10/1987 |
| EP | 0 253 567 | B1 | 1/1988 |
| EP | 0 256 696 | A1 | 2/1988 |
| EP | 0 258 068 | B1 | 3/1988 |
| EP | 0 262 588 | A2 | 4/1988 |
| EP | 0 265 832 | B1 | 5/1988 |
| EP | 0 269 977 | B1 | 6/1988 |
| EP | 0 270 974 | B1 | 6/1988 |
| EP | 0 271 312 | B1 | 6/1988 |
| EP | 0 272 033 | A2 | 6/1988 |
| EP | 0 273 125 | B1 | 7/1988 |
| EP | 0 274 907 | B1 | 7/1988 |
| EP | 0 276 997 | A2 | 8/1988 |
| EP | 0 286 342 | B1 | 10/1988 |
| EP | 0 294 753 | B1 | 12/1988 |
| EP | 0 301 298 | B1 | 2/1989 |

| | | | |
|---|---|---|---|
| EP | 0 301 414 | B1 | 2/1989 |
| EP | 0 305 216 | B1 | 3/1989 |
| EP | 0 309 931 | B1 | 4/1989 |
| EP | 0 330 641 | B1 | 8/1989 |
| EP | 0 331 376 | B1 | 9/1989 |
| EP | 0 334 462 | B2 | 9/1989 |
| EP | 0 339 550 | B1 | 11/1989 |
| EP | 0 341 947 | B1 | 11/1989 |
| EP | 0 357 280 | B1 | 3/1990 |
| EP | 0 357 969 | B1 | 3/1990 |
| EP | 0 362 671 | A1 | 4/1990 |
| EP | 0 375 102 | B1 | 6/1990 |
| EP | 0 376 705 | A1 | 7/1990 |
| EP | 0 378 261 | B1 | 7/1990 |
| EP | 0 378 262 | B1 | 7/1990 |
| EP | 0 384 717 | A1 | 8/1990 |
| EP | 0 385 401 | A1 | 9/1990 |
| EP | 0 425 427 | B1 | 5/1991 |
| EP | 0 425 428 | B1 | 5/1991 |
| EP | 0 436 835 | B2 | 7/1991 |
| EP | 0 451 921 | B1 | 10/1991 |
| EP | 0 468 102 | B1 | 1/1992 |
| EP | 0 502 325 | B1 | 9/1992 |
| EP | 0 511 456 | A1 | 11/1992 |
| EP | 0 548 599 | B1 | 6/1993 |
| EP | 0 583 536 | B1 | 2/1994 |
| EP | 0 634 481 | B1 | 1/1995 |
| EP | 0 703 190 | | 3/1996 |
| EP | 0 948 591 | B1 | 10/1999 |
| FR | 1419645 | | 7/1964 |
| FR | 2 237 960 | | 2/1975 |
| GB | 1154730 | | 6/1969 |
| GB | 1377092 | | 12/1974 |
| GB | 1 413 283 | | 11/1975 |
| GB | 1534641 | | 12/1978 |
| GB | 1547275 | | 6/1979 |
| GB | 1578930 | | 11/1980 |
| GB | 2094826 | | 9/1982 |
| GB | 2095275 | | 9/1982 |
| GB | 2 124 244 | | 2/1984 |
| GB | 2165856 | | 4/1986 |
| GB | 2 290 798 | A | 1/1996 |
| GB | 2 295 623 | A | 6/1996 |
| GB | 2317390 | | 3/1998 |
| JP | 59-15573 | | 1/1984 |
| JP | 60-137938 | | 7/1985 |
| JP | 04/238809 | | 8/1994 |
| JP | 04/260610 | | 9/1994 |
| WO | WO 90/10695 | | 9/1990 |
| WO | WO 90/13533 | | 11/1990 |
| WO | WO 91/01295 | | 2/1991 |
| WO | WO 91/02792 | | 3/1991 |
| WO | WO 91/08171 | | 6/1991 |
| WO | WO 91/13138 | | 9/1991 |
| WO | WO 91/16422 | | 10/1991 |
| WO | WO 92/06984 | | 4/1992 |
| WO | WO 93/08251 | | 4/1993 |
| WO | WO 93/11215 | | 6/1993 |
| WO | WO 93/16110 | | 8/1993 |
| WO | WO 95/02555 | | 1/1995 |
| WO | WO 95/02675 | | 1/1995 |
| WO | WO 96/06615 | | 3/1996 |
| WO | WO 96/20997 | | 7/1996 |
| WO | WO 96/25477 | | 8/1996 |
| WO | WO 97/14804 | | 4/1997 |
| WO | WO 98/29528 | | 7/1998 |
| WO | WO 00/50553 | | 8/2000 |
| WO | WO 00/50556 | | 8/2000 |
| WO | WO 02/12425 | A1 | 2/2002 |
| WO | WO 02/12426 | A1 | 2/2002 |
| WO | WO 02/26927 | A1 | 4/2002 |
| WO | WO 02/092751 | | 11/2002 |
| WO | WO 02/094882 | | 11/2002 |

OTHER PUBLICATIONS

Rodriguez, F., et al. (1964): The Flow of Moderately Concentrated Polymer Solutions in Water. Transactions of the Society of Rheology VIII, pp. 3-17.

Puchta, R., et al. (1993): A New Generation of Softners. Tens. Surf. Det., 30: 186, 6 pages.

Brock, M. (1993): Neue Entwicklungen auf dem Gebiet der Wascheweichspuler. Tens. Surf. Det., 30: 394-399.

Lagerman, R., et al. (1994): Synthetis and Performance of Ester Quaternary Biodegradable Softners. J. Am. Oil. Chem. Soc. vol. 71. pp. 97-100.

Shapiro, I. et al. (1994): Environmentally Friendly Ester Quats. Cosm. Toil. vol. 109. 3 Pages starting at p. 77.

Mackenzie, R.C., et al. (1962): Differential Thermal Analysis. The Analyst. vol. 87. pp. 420-434. (Cited in H06139).

Online-Entry from Nov. 8, 2004 from STN File Chemical Abstracts, 103: 179620, JP 60137938 A.

Derwent-Reference: AN: 1985-214358 JP 60-137938 (1985).

Carrion, Fite, F.J., "Behavior of Cellulose ethers when used as anti-redeposition agents during washing: relationship between the deposition and the zeta potential of polyester-cotton using different finishes," Journal of the Textile Institute, Manchester, GB, 84:582-592, (1993) (cited on ISR for H06162).

Derwent Reference: AN: 1984-058741; JP 1984-5915537 (1984).

Derwent document: JP 61266672, Nov. 26, 1986, Asahi Chem. Ind. Co., AN: 1987-031689.

* cited by examiner

BLEACH-CONTAINING LAUNDRY DETERGENTS OR CLEANING COMPOSITIONS COMPRISING WATER-SOLUBLE BUILDER SYSTEM AND SOIL RELEASE-CAPABLE CELLULOSE DERIVATIVE

CROSS-REFERENCE TO RELATED APPLICATIONS

This application is a continuation under 35 U.S.C. § 365(c) and 35 U.S.C. § 120 of international application PCT/EP2004/000875, filed Jan. 31, 2004. This application also claims priority under 35 U.S.C. § 119 of DE 103 05 306.9, filed Feb. 10, 2003 and of DE 103 51 326.4, filed on Oct. 31, 2003, each of which is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates to laundry detergents or cleaning compositions which have, as a builder component, only water-soluble constituents and comprise soil release-capable cellulose derivative and bleaches.

In addition to the surfactants which are indispensable for the washing and cleaning performance, laundry detergents and cleaning compositions also comprise what are known as builder substances which have the task of promoting the performance of the surfactants by attempting to eliminate hardness formers, i.e. substantially calcium and magnesium ions, out of the wash liquor in such a way that they do not interact adversely with the surfactants. Polyphosphates, in particular trisodium polyphosphate were formerly used very successfully for this purpose. A further known example of such builder substances which improve the primary washing action is zeolite Na-A, which is known to be capable of forming such stable complexes with calcium ions in particular that their reaction with water hardness-forming anions, in particular carbonate, to form insoluble compounds is suppressed. In addition, the builders, especially in textile laundry detergents, are intended to prevent the reattachment of the soil released from the fiber or generally from the surface to be cleaned, and also insoluble compounds which form by the reaction of water hardness-forming cations with water hardness-forming anions on the cleaned textile or the surface. For this purpose, what are known as cobuilders, generally polymeric polycarboxylates, are typically used, which, in addition to their contribution to the secondary washing capacity, advantageously also have complexing action against the water hardness-forming cations.

In addition to the indispensable ingredients mentioned, such as surfactants and builder materials, laundry detergents generally comprise further constituents which can be summarized under the term washing assistants and which comprise such different active substance groups as foam regulators, graying inhibitors, bleaches, enzymes and dye transfer inhibitors. Such assistants also includes substances which impart to the laundry fiber soil-repellent properties and which, if present during the washing operation, are capable of promoting the soil release capability of the remaining laundry detergent constituents. The same applies mutatis mutandis for cleaning compositions for hard surfaces. Such soil release-capable substances are often referred to as "soil release" active substances or, owing to their capability of modifying the treated surface, for example of the fiber, in a soil-repellent manner, as "soil repellents". For example, the American patent U.S. Pat. No. 4,136,038 discloses the soil release-capable action of methylcellulose. The European patent application EP 0 213 729 discloses the reduced redeposition in the case of use of laundry detergents which comprise a combination of soap and non-ionic surfactant comprising alkylhydroxyalkylcellulose. The European patent application EP 0 213 730 discloses textile treatment compositions which comprise cationic surfactants and non-ionic cellulose ethers having HLB values of from 3.1 to 3.8. The American patent U.S. Pat. No. 4,000,093 discloses laundry detergents which comprise from 0.1% by weight to 3% by weight of alkylcellulose, hydroxyalkylcellulose or alkylhydroxyalkylcellulose, and also from 5% by weight to 50% by weight of surfactant, the surfactant component consisting substantially of $C_{10}$- to $C_{13}$-alkyl sulfate and having up to 5% by weight of $C_{14}$-alkyl sulfate and fewer than 5% by weight of alkyl sulfate having alkyl radicals of $C_{15}$ and higher. The American patent U.S. Pat. No. 4,174,305 discloses laundry detergents which comprise from 0.1% by weight to 3% by weight of alkylcellulose, hydroxyalkylcellulose or alkylhydroxyalkylcellulose, and also from 5% by weight to 50% by weight of surfactant, the surfactant component consisting substantially of $C_{10}$- to $C_{12}$-alkylbenzenesulfonate and having fewer than 5% by weight of alkylbenzenesulfonate having alkyl radicals of $C_{13}$ and higher. The European patent application EP 0 634 481 relates to a laundry detergent which comprises alkali metal percarbonate and one or more non-ionic cellulose derivatives. Among the latter, explicitly disclosed are merely hydroxyethylcellulose, hydroxypropylcellulose and methylcellulose, and also, within the examples, the methylhydroxyethylcellulose Tylose® MH50, the hydroxypropylmethylcellulose Methocel® F4M and hydroxybutylmethylcellulose. The European patent EP 0 271 312 (P&G) relate to soil release-capable active substances, and among these cellulose alkyl ethers and cellulose hydroxylalkyl ethers (having DS from 1.5 to 2.7 and molar masses of from 2000 to 100 000) such as methylcellulose and ethylcellulose, which are to be used with peroxygen bleach in a weight ratio (based on the active oxygen content of the bleach) of from 10:1 to 1:10. The European patent EP 0 948 591 B1 discloses a laundry detergent in liquid or granular form which imparts to fabrics and textiles which are washed therewith textile appearance advantages such as pilling/fuzz reduction, counteraction of dye fading, improved attrition resistance and/or enhanced softness, and which contains from 1 to 80% by weight of surfactant, from 1 to 80% by weight of organic or inorganic builder, from 0.1 to 80% by weight of a hydrophobically modified non-ionic cellulose ether having a molar mass of from 10 000 to 2 000 000, the modification consisting in the presence of optionally oligomerized (degree of oligomerization up to 20) ethyleneoxy or 2-propyleneoxy ether units and of $C_{8-24}$- alkyl substituents, and the alkyl substituents having to be present in amounts of 0.1-5% by weight based on the cellulose ether material.

Owing to their chemical similarity to polyester fibers, particularly effective soil release-capable active ingredients in the case of textiles composed of this material are copolyesters which contain dicarboxylic acid units, alkylene glycol units and polyalkylene glycol units. Soil release-capable copolyesters of the type mentioned and also their use in laundry detergents have been known for some time.

For example, the German laid-open specification DT 16 17 141 describes a washing process using polyethylene terephthalate-polyoxyethylene glycol copolymers. The German laid-open specification DT 22 00 911 relates to laundry detergents which comprise non-ionic surfactant and a copolymer composed of polyoxyethylene glycol and polyethylene terephthalate. The German laid-open specification DT 22 53 063 mentions acidic textile modifying compositions which comprise a copolymer composed of a dibasic carboxylic acid and an alkylene polyglycol or cycloalkylene polyglycol, and also optionally an alkylene glycol or cycloalkylene glycol. Polymers composed of ethylene terephthalate and polyethylene oxide terephthalate in which the polyethylene glycol units have molar masses of from 750 to 5000 and the molar ratio of ethylene terephthalate to polyethylene oxide terephthalate is from 50:50 to 90:10, and their use in laundry detergents are described in the German patent DE 28 57 292. Polymers having molar mass from 15 000 to 50 000 and composed of ethylene terephthalate and polyethylene oxide terephthalate, the polyethylene glycol units having molar masses of from 1000 to 10 000 and the molar ratio of ethylene terephthalate to polyethylene oxide terephthalate being from 2:1 to 6:1, can be used in laundry detergents according to the German laid-open specification DE 33 24 258. The European patent EP 066 944 relates to textile treatment compositions which comprise a copolyester composed of ethylene glycol, polyethylene glycol, aromatic dicarboxylic acid and sulfonated aromatic dicarboxylic acid in certain molar ratios. The European patent EP 185 427 discloses polyesters which are end group-capped by methyl or ethyl groups and have ethylene terephthalate and/or propylene terephthalate and polyethylene oxide terephthalate units, and laundry detergents which comprise such soil release polymers. The European patent EP 241 984 relates to a polyester which, in addition to oxyethylene groups and terephthalic acid units, also contains substituted ethylene units and glycerol units. The European patent EP 241 985 discloses polyesters which, in addition to oxyethylene groups and terephthalic acid units, contain 1,2-propylene, 1,2-butylene and/or 3-methoxy-1,2-propylene groups and also glycerol units, and are end group-capped with $C_1$- to $C_4$-alkyl groups. The European patent EP 253 567 relates to soil release polymers which have a molar mass of from 900 to 9000 and are composed of ethylene terephthalate and polyethylene oxide terephthalate, the polyethylene glycol units having molar masses of from 300 to 3000 and the molar ratio of ethylene terephthalate to polyethylene oxide terephthalate being from 0.6 to 0.95. The European patent application EP 272 033 discloses polyesters which are at least partly end group-capped by $C_{1-4}$-alkyl or acyl radicals and have polypropylene terephthalate and polyoxyethylene terephthalate units. The European patent EP 274 907 describes terephthalate-containing soil release polyesters which are end group-capped by sulfoethyl. In the European patent application EP 357 280, soil release polyesters having terephthalate, alkylene glycol and poly-$C_{2-4}$-glycol units are prepared by sulfonation of unsaturated end groups. The German patent application DE 26 55 551 describes the reaction of such polyesters with isocyanate-containing polymers and the use of the thus prepared polyesters against the reattachment of soil in the course of washing of synthetic fibers. The German patent application DE 28 46 984 discloses laundry detergents which comprise, as a soil release-capable polymer, a reaction product of a polyester with a prepolymer containing terminal isocyanate groups, obtained from a diisocyanate and a hydrophilic non-ionic macrodiol.

The majority of the polymers known from this extensive prior art have the disadvantage that, in the case of textiles which do not consist, or at least do not consist predominantly, of polyester, they only have insufficient, if any, effectiveness. However, a large part of modern textiles consists of cotton or cotton-polyester mixed fabrics, so that there is a need for soil release-capable polymers having better activity in the case of greasy stains on such textiles.

Among the above-mentioned washing assistants, particular significance is attached to the bleaches especially with regard to the enhancement of the washing or cleaning performance with respect to a multitude of different stains. Such assistants include substances which promote the surfactant performance in laundry detergents by the oxidative degradation of stains present on the textile or those which are present in the liquor after the release from the textile. The same also applies mutatis mutandis to cleaning compositions for hard surfaces. For instance, inorganic peroxygen compounds, in particular hydrogen peroxide and solid peroxygen compounds which dissolve in water with release of hydrogen peroxide or what is known as active oxygen, such as sodium perborate and sodium carbonate perhydrate, have been used for some time as oxidizing agents for disinfection and bleaching purposes. The latter compound, which is often referred to as sodium percarbonate for short, is the addition compound of hydrogen peroxide to sodium carbonate (empirical formula $2\ Na_2CO_3.3H_2O_2$). The carbonate salts of the remaining alkali metals also form $H_2O_2$ addition compounds. Owing to the storage stability, often found to be insufficient, of the alkali metal carbonate in a warm, moist environment and in the presence of other customary laundry detergent and cleaning composition components, the alkali metal percarbonate normally has to be stabilized against the loss of active oxygen. An essential principle in the stabilization is to surround the alkali metal percarbonate particles with a coating which may have a single-layer or multilayer structure. Each coating layer may comprise one or more inorganic and/or organic coating components.

It has now been found that, surprisingly, the soil release-capable action of cellulose derivatives is particularly marked when they are used in laundry detergents or cleaning compositions which comprise alkali metal percarbonates and are free of water-insoluble builder material, i.e. comprise only water-soluble builders.

The invention therefore provides a builder-containing laundry detergent or cleaning composition comprising a water-soluble builder block, alkali metal percarbonate and soil release-capable cellulose derivative which is obtainable by alkylation and hydroxyalkylation of cellulose.

BRIEF SUMMARY OF THE INVENTION

One aspect of the present invention pertains to a builder-containing laundry detergent or cleaning composition comprising: (1) alkali metal percarbonate; (2) a water-soluble builder block which comprised of:

a) from 5% by weight to 35% by weight of citric acid, an alkali metal citrate, an alkali metal carbonate, and/or an alkali metal hydrogen carbonate,
b) up to 10% by weight of alkali metal silicate having a modulus in the range from 1.8 to 2.5,
c) up to 2% by weight of phosphonic acid and/or alkali metal phosphate,
d) up to 50% by weight of alkali metal phosphate, and
e) up to 10% by weight of polymeric polycarboxylate, wherein at least two of components b), c), d) and e) are present in amounts greater than 0% by weight, and (3) a soil release-capable alkyl or hydroxyalkyl cellulose derivative.

Another aspect of the present invention pertains to a method of cleaning a textile material comprising contacting a textile material with a builder-containing laundry detergent or cleaning composition comprising: (1) alkali metal percarbonate; (2) a water-soluble builder block which comprised of:

a) from 5% by weight to 35% by weight of citric acid, an alkali metal citrate, an alkali metal carbonate, and/or an alkali metal hydrogen carbonate,
b) up to 10% by weight of alkali metal silicate having a modulus in the range from 1.8 to 2.5,
c) up to 2% by weight of phosphonic acid and/or alkali metal phosphate,
d) up to 50% by weight of alkali metal phosphate, and
e) up to 10% by weight of polymeric polycarboxylate, wherein at least two of components b), c), d) and e) are present in amounts greater than 0% by weight, and (3) a soil release-capable alkyl or hydroxyalkyl cellulose derivative.

Another aspect of the present invention pertains to the use of soil release-capable cellulose derivative which is obtainable by alkylation and hydroxyalkylation of cellulose for enhancing the cleaning action of alkali metal percarbonate-containing laundry detergents which have a water-soluble builder block in the washing of textiles which in particular consist of cotton or comprise cotton.

In addition to alkali metal percarbonate, the water-soluble builder block and the soil release-capable cellulose derivative, the composition may comprise all further ingredients customary in laundry detergents or cleaning compositions as long as they do not interact adversely with them or one of them in an unacceptable manner. However, the use of the term "builder block" is intended to express that the compositions comprise no builder substances other than those which are water-soluble, i.e. all builder substances present in the composition are summarized in the thus characterized "block", excluding at most the amounts of substances which may be present in a commercially customary manner as impurities or stabilizing additives in small amounts in the remaining ingredients of the composition. Preferred inventive compositions comprise no additional bleach in addition to the alkali metal percarbonate mentioned, although this is possible if desired. Preference is given to bleaches in which the fraction of alkali metal percarbonates is from 6% by weight to 30% by weight, in particular from 10% by weight to 25% by weight. Here and at all other points in the present description, the preferred alkali metal is sodium, although it is also possible if desired to use lithium, potassium and rubidium salts.

BRIEF DESCRIPTION OF THE SEVERAL VIEWS OF THE DRAWING(S)

Not Applicable

DETAILED DESCRIPTION OF THE INVENTION

In regard to the process for washing textiles according to the invention, in which an alkali metal percarbonate-containing laundry detergent having a water-soluble builder block and a soil release-capable cellulose derivative which is obtainable by alkylation and hydroxyalkylation of cellulose is used. This process may be performed manually or preferably with the aid of a customary domestic washing machine. It is possible to use the bleach-containing laundry detergent and the soil release-capable cellulose derivative simultaneously or successively. The simultaneous use can be carried out particularly advantageously by the use of a bleach-containing laundry detergent which comprises the soil release-capable cellulose derivative.

The washing performance-enhancing effect of the cellulose derivatives to be used in accordance with the invention on repeated use, i.e. in particular for the removal of stains from appropriate textiles which have already been washed and/or after-treated in the presence of the cellulose derivative before they have been stained. In connection with the after-treatment, it should be pointed out that the positive aspect indicated can also be realized by a washing process in which the textile, after the actual washing operation which is performed with the aid of a percarbonate-containing laundry detergent with water-soluble builder block (which may comprise said cellulose derivative but in this case may also be free thereof), is contacted with an after-treatment composition, for example in a fabric softening step, which comprises a cellulose derivative to be used in accordance with the invention. In this procedure too, even if, if desired, no laundry detergent comprising said cellulose derivative is used in the next washing operation, the washing performance-enhancing effect of the cellulose derivative to be used in accordance with the invention occurs.

Preferred cellulose derivatives are those which have been alkylated with $C_1$ to $C_{10}$ groups, in particular $C_1$ to $C_3$ groups, and additionally bear $C_2$ to $C_{10}$ hydroxyalkyl groups, in particular $C_2$ to $C_3$ hydroxyalkyl groups. These can be obtained in a known manner by reacting cellulose with appropriate alkylating agents, for example alkyl halides or alkyl sulfates, and subsequent reaction with appropriate alkylene oxides, for example ethylene oxide and/or propylene oxide. In a preferred embodiment of the invention, the cellulose derivative contains on average from 0.5 to 2.5, in particular from 1 to 2, alkyl groups, and from 0.02 to 0.5, in particular from 0.05 to 0.3, hydroxyalkyl group per anhydroglycose monomer unit. The average molar mass of the cellulose derivatives used in accordance with the invention is preferably in the range from 10 000 D to 150 000 D, in particular from 40 000 D to 120 000 D and more preferably in the range from 80 000 D to 110 000 D. The determination of the degree of polymerization and of the molecular weight of the soil release-capable cellulose derivative is based on the determination of the limiting viscosity number on sufficiently dilute aqueous solutions by means of an Ubbelohde capillary viscometer (Oc capillary). Using a constant [H. Staudinger and F. Reinecke, "Über Molekulargewichtsbestimmung an Celluloseethern" [On molecular weight determination of cellulose ethers], Liebigs Annalen der Chemie 535, 47 (1938)] and a correction factor [F. Rodriguez and L. A. Goettler, "The Flow of Moderately Concentrated Polymer Solutions in Water", Transactions of the Society of Rheology VIII, 3 17 (1964)] it is possible to calculate therefrom the degree of polymerization and, with incorporation of the degrees of substitution (DS and MS), the corresponding molecular weight.

As stated, the cellulose derivatives used in accordance with the invention can be prepared in a simple manner and are both ecologically and toxicologically safe. They lead to significantly better removal of especially grease and cosmetic stains on cotton or cotton-containing fabrics than is the case when compounds known to date for this purpose are used. Alternatively, significant amounts of surfactants can be saved for equal grease removal capability.

In the context of a washing process, the inventive use may be such that alkali metal percarbonate and the cellulose derivative are added to a laundry detergent-containing liquor, the cellulose derivative is added separately to a bleach- and laundry detergent-containing liquor, or, preferably, the cellulose derivative is introduced into the liquor as a constituent of an inventive laundry detergent.

In the context of a laundry after-treatment process, the inventive use may correspondingly be such that the cellulose derivative is added separately to the rinse liquor which is used after the washing cycle executed with use of a percarbonate-containing laundry detergent comprising water-soluble builder block, or that it is introduced as a constituent of the laundry after-treatment composition, in particular a fabric softener. In this aspect of the invention, said percarbonate-containing laundry detergent comprising water-soluble builder block may likewise be a cellulose derivative to be used in accordance with the invention, but may also be free thereof. Conversely, said laundry after-treatment composition may also comprise a percarbonate and/or water-soluble builder block, but may also be free thereof.

The alkali metal percarbonate present in the inventive compositions is preferably used in the form of coated alkali metal percarbonate particles which have an alkali metal percarbonate core which has been obtained by any preparation process and may also contain stabilizers known per se, such as magnesium salts, silicates and phosphates. The preparation processes customary in practice are in particular what are known as crystallization processes and fluidized bed spray granulation processes. In the crystallization process, hydrogen peroxide and alkali metal carbonates are reacted in the aqueous phase to give alkali metal percarbonate and the latter is removed from the aqueous mother liquor after the crystallization. While alkali metal percarbonate was crystallized out in the presence of a higher concentration of an inert salt such as sodium chloride in earlier processes, processes have also become known in which the crystallization can also be effected in the absence of a salting agent. Reference is made by way of example to the European patent application EP 0 703 190. In the fluidized bed spray granulation, an aqueous hydrogen peroxide solution and an aqueous alkali metal carbonate solution are sprayed onto alkali metal carbonate seeds which are disposed in a fluidized bed, and water is simultaneously evaporated. The granule which grows in the fluidized bed is removed from the fluidized bed in its entirety or in a classifying manner. As examples of such a preparation process, reference is made to the international patent application WO 96/06615. Finally, the core of the alkali metal percarbonate particles may also be alkali metal percarbonate which has been obtained by a process comprising contacting of solid alkali metal carbonate or a hydrate thereof with an aqueous hydrogen peroxide solution and drying.

An alkali metal percarbonate present with particular preference in the inventive compositions is particulate and has at least two coating layers, an innermost layer comprising at least one hydrate-forming inorganic salt and an outer layer comprising alkalimetal silicate. The outer coating layer comprising alkalimetal silicate may either be the outermost coating layer of a coating comprising at least two layers, or a coating layer which is not the innermost disposed directly on the alkali metal percarbonate and may in turn be covered by one layer or a plurality of layers. Even though individual layers are discussed both here and in the prior art, it should be emphasized that the constituents of the layers lying one on top of another may merge into one another at least in the boundary region. This at least partial penetration results from the partial dissolution at least on the surface when a solution which comprises a coating component or the coating components of a second coating layer is sprayed in the course of coating of alkali metal percarbonate particles which have an innermost coating layer.

A further essential feature of inventive compositions is that they comprise a water-soluble builder block. In this context, the term "water-soluble" is understood to mean that the builder block dissolves without residue to an extent of at least 3 g/l, in particular at least 6 g/l, in water of pH 7 at room temperature. The builder block is preferably soluble without residue at the concentration which results from the use amount of the laundry detergent present therein under the customary washing conditions.

The inventive compositions preferably contain at least 15% by weight and up to 55% by weight, in particular from 25% by weight to 50% by weight, of water-soluble builder block. This is preferably composed of the components a) from 5% by weight to 35% by weight of citric acid, alkali metal citrate and/or alkali metal carbonate which may be replaced at least partly by alkali metal hydrogencarbonate,
b) up to 10% by weight of alkalimetal silicate having a modulus in the range from 1.8 to 2.5,
c) up to 2% by weight of phosphonic acid and/or alkali metal phosphate,
d) up to 50% by weight of alkali metal phosphate, and
e) up to 10% by weight of polymeric polycarboxylate, the quantitative data being based on the entire laundry detergent or cleaning composition. This also applies to all of the following quantitative data unless explicitly stated otherwise.

In a preferred embodiment of inventive compositions, the water-soluble builder block comprises at least 2 of components b), c), d) and e) in amounts greater than 0% by weight.

With regard to component a), in a preferred embodiment of inventive compositions, from 15% by weight to 25% by weight of alkali metal carbonate which may be replaced at least partly by alkali metal hydrogencarbonate and up to 5% by weight, in particular from 0.5% by weight to 2.5% by weight, of citric acid and/or alkali metal citrate are present. In an alternative embodiment of inventive compositions, from 5% by weight to 25% by weight, in particular from 5% by weight to 15% by weight of citric acid and/or alkali metal citrate and up to 5% by weight, in particular from 1% by weight to 5% by weight, of alkali metal carbonate which may be replaced at least partly by alkali metal hydrogencarbonate are present as component a). If both alkali metal carbonate and alkali metal hydrogencarbonate are present, component a) has alkali metal carbonate and alkali metal hydrogencarbonate preferably in a weight ratio of from 10:1 to 1:1.

With regard to component b), in a preferred embodiment of inventive compositions, from 1% by weight to 5% by weight of alkali metal silicate having a modulus in the range from 1.8 to 2.5 is present.

With regard to component c), in a preferred embodiment of inventive compositions, from 0.05% by weight to 1% by weight of phosphonic acid and/or alkali metal phosphonate is present. In this context, phosphonic acids are also understood to be optionally substituted alkylphosphonic acids which may also have a plurality of phosphonic acid moieties (known as polyphosphonic acids). They are preferably selected from the hydroxy- and/or aminoalkylphosphonic acids and/or alkali metal salts thereof, for example dimethylaminomethanediphosphonic acid, 3-aminopropane-1-hydroxy-1,1-diphosphonic acid, 1-amino-1-phenylmethanediphosphonic acid, 1-hydroxyethane-1,1-diphosphonic acid, aminotris(methylenephosphonic acid), N,N,N',N'-ethylenediaminetetrakis(methylenephosphonic acid) and the acylated derivatives of phosphorous acid described in the German published specification DE 11 07 207, which may also be used in any desired mixtures.

With regard to component d), in a preferred embodiment of inventive compositions, from 15% by weight to 35% by weight of alkali metal phosphate, in particular trisodium polyphosphate, is present. Alkali metal phosphate is the collective term for the alkali metal (especially sodium and potassium) salts of the various phosphoric acids, for which a distinction may be drawn between metaphosphoric acids $(HPO_3)_n$ and orthophosphoric acid $H_3PO_4$, in addition to higher molecular weight representatives. The phosphates combine several advantages: they act as alkali carriers, prevent limescale deposits on machine components and lime encrustations in fabrics, and additionally contribute to the cleaning performance. Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water and which lose the water of crystallization upon heating and are converted at 200° C. to the weakly acidic diphosphate (disodium hydrogendiphosphate, $Na_2H_2P_2O_7$), and at higher temperature to sodium trimetaphosphate ($Na_3P_3O_9$) and Maddrell salt. $NaH_2PO_4$ reacts acidically; it is formed when phosphoric acid is adjusted to a pH of 4.5 using sodium hydroxide solution and the slurry is spray-dispensed. Potassium dihydrogenphosphate (primary or monobasic potassium phosphate, potassium biphosphate, KDP), $KH_2PO_4$, is a white salt of density of 2.33 $gcm^{-3}$, has a melting point of 253° [decomposition with formation of $(KPO_3)_x$, potassium polyphosphate] and is readily soluble in water. Disodium hydrogenphosphate (secondary sodium phosphate), $Na_2HPO_4$, is a colorless crystalline salt which is very readily soluble in water. It exists in anhydrous form and with 2 mol of water (density 2.066 $gcm^{-3}$, loss of water at 95°), 7 mol of water (density 1.68 $gcm^{-3}$, melting point 48° with loss of 5 $H_2O$) and 12 mol of water (density 1.52 $gcm^{-3}$, melting point 35° with loss of 5 $H_2O$), becomes anhydrous at 100° and, when heated more strongly, is converted to the diphosphate $Na_4P_2O_7$. Disodium hydrogenphosphate is prepared by neutralizing phosphoric acid with sodium carbonate solution using phenolphthalein as an indicator. Dipotassium hydrogenphosphate (secondary or dibasic potassium phosphate), $K_2HPO_4$, is an amorphous white salt which is readily soluble in water. Trisodium phosphate, tertiary sodium phosphate, $Na_3PO_4$, are colorless crystals which have a density of 1.62 $gcm^{-3}$ and a melting point of 73-76° C. (decomposition) in the form of the dodecahydrate, have a melting point of 100° C. in the form of the decahydrate (corresponding to 19-20% $P_2O_5$), and have a density of 2.536 $gcm^{-3}$ in anhydrous form (corresponding to 39-40% $P_2O_5$). Trisodium phosphate is readily soluble in water with an alkaline reaction, and is prepared by evaporatively concentrating a solution of precisely 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1340° and is readily soluble in water with an alkaline reaction. It is produced, for example, when Thomas slag is heated with charcoal and potassium sulfate. In spite of the relatively high cost, the more readily soluble and therefore highly active potassium phosphates are frequently preferred in the cleaning products industry over corresponding sodium compounds. Tetrasodium diphosphate (sodium pyrophosphate), $Na_4P_2O_7$, exists in anhydrous form (density 2.534 $gcm^{-3}$, melting point 988°, 880° also reported) and in the form of the decahydrate (density 1.815-1.836 $gcm^{-3}$, melting point 94° with loss of water). Both substances are colorless crystals which dissolve in water with an alkaline reaction. $Na_4P_2O_7$ is formed when disodium phosphate is heated to >200° or by reacting phosphoric acid with sodium carbonate in the stoichiometric ratio and dewatering the solution by spraying. The decahydrate complexes heavy metal salts and hardness formers and therefore reduces the hardness of water. Potassium diphosphate (potassium pyrophosphate), $K_4P_2O_7$, exists in the form of the trihydrate and is a colorless, hygroscopic powder of density 2.33 $gcm^{-3}$, which is soluble in water, the pH of the 1% solution at 25° being 10.4. Condensation of $NaH_2PO_4$ or of $KH_2PO_4$ gives rise to higher molecular weight sodium phosphates and potassium phosphates, for which a distinction can be drawn between cyclic representatives, the sodium metaphosphates and potassium metaphosphates, and catenated types, the sodium polyphosphates and potassium polyphosphates. For the latter in particular a multitude of names are in use: fused or calcined phosphates, Graham salt, Kurrol salt and Maddrell salt. All higher sodium and potassium phosphates are referred to collectively as condensed phosphates. The industrially important pentasodium triphosphate, $Na_5P_3O_{10}$ (sodium tripolyphosphate), is a nonhygroscopic, white, water-soluble salt which is anhydrous or crystallizes with 6 $H_2O$ and has the general formula NaO—[P(O)(ONa)—O]$_n$—Na where n=3. About 17 g of the salt which is free of water of crystallization dissolve in 100 g of water at room temperature, at 60° approx. 20 g, at 100° around 32 g; after the solution has been heated at 100° for two hours, hydrolysis forms about 8% orthophosphate and 15% diphosphate. In the preparation of pentasodium triphosphate, phosphoric acid is reacted with sodium carbonate solution or sodium hydroxide solution in the stoichiometric ratio and the solution is dewatered by spraying. In a similar way to Graham salt and sodium diphosphate, pentasodium triphosphate dissolves many insoluble metal compounds (including lime soaps etc.). Pentapotassium triphosphate, $K_5P_3O_{10}$ (potassium tripolyphosphate), is available commercially, for example, in the form of a 50% by weight solution (>23% $P_2O_5$, 25% $K_2O$). The potassium polyphosphates find wide use in the laundry detergents and cleaning products industry. There also exist sodium potassium tripolyphosphates which can likewise be used in the context of the present invention. They are formed, for example, when sodium trimetaphosphate is hydrolyzed with KOH:

$$(NaPO_3)_3+2\ KOH \rightarrow Na_3K_2P_3O_{10}+H_2O$$

They can be used in accordance with the invention in precisely the same way as sodium tripolyphosphate, potassium tripolyphosphate or mixtures of the two; mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate can also be used in accordance with the invention.

With regard to component e), in a preferred embodiment of inventive compositions, from 1.5% by weight to 5% by weight of polymeric polycarboxylate, especially selected from the polymerization or copolymerization products of acrylic acid, methacrylic acid and/or maleic acid, is present. Among these, particular preference is given to the homopolymers of acrylic acid and among these in turn to those having an average molar mass in the range from 5000 D to 15 000 D (PA standard).

Laundry detergents or cleaning compositions which comprise a cellulose derivative or water-soluble builder block or alkali metal percarbonate to be used in accordance with the invention or are used together with one or more of them or in the process according to the invention may comprise all customary other constituents of such compositions which do not interact in an undesired manner with the cellulose derivative which is essential to the invention, the alkali metal percarbonate or the water-soluble builder block. The cellulose derivative is incorporated into laundry detergents or cleaning compositions preferably in amounts of from 0.1% by weight to 5% by weight, in particular from 0.5% by weight to 2.5% by weight.

It has been found that, surprisingly, such cellulose derivatives having the above-specified properties positively influence the action of certain other laundry detergent and cleaning composition ingredients and that, conversely, the action of the cotton-active soil release cellulose derivative is additionally enhanced by certain other laundry detergent ingredients. These effects occur in particular in the case of active enzymatic ingredients, in particular proteases and lipases, in the case of sulfate- and sulfonate-type synthetic anionic surfactants, in the case of dye transfer inhibitors, for example vinylpyrrolidone, vinylpyridine or vinylimidazole polymers or copolymers, or corresponding polybetaines, and in the case of graying inhibitors, for example other, especially anionic, cellulose ethers such as carboxymethylcellulose, which is why the use of at least one of the further ingredients mentioned together with cellulose derivatives to be used in accordance with the invention is preferred.

In a preferred embodiment, an inventive composition, a composition used in accordance with the invention or a composition used in the process according to the invention comprises non-ionic surfactant selected from fatty alkyl polyglycosides, fatty alkyl polyalkoxylates, in particular ethoxylates and/or propoxylates, fatty acid polyhydroxy amides and/or ethoxylation and/or propoxylation products or fatty alkyl amines, vicinal diols, fatty acid alkyl esters and/or fatty acid amides and mixtures thereof, in particular in an amount in the range from 2% by weight to 25% by weight.

A further embodiment of such compositions includes the presence of synthetic sulfate- and/or sulfonate-type anionic surfactant, in particular fatty alkyl sulfate, fatty alkyl ether sulfate, sulfo fatty acid esters and/or sulfo fatty acid disalts, in particular in an amount in the range from 2% by weight to 25% by weight. The anionic surfactant is preferably selected from the alkyl or alkenyl sulfates and/or the alkyl or alkenyl ether sulfates, in which the alkyl or alkenyl group has from 8 to 22, in particular from 12 to 18, carbon atoms. These are typically not single substances but rather cuts or mixtures. Among these, preference is given to those whose fraction of compounds having longer-chain radicals in the range from 16 to 18 carbon atoms is above 20%.

The useful non-ionic surfactants include the alkoxylates, in particular the ethoxylates and/or propoxylates, of saturated or mono- or polyunsaturated linear or branched-chain alcohols having from 10 to 22 carbon atoms, preferably from 12 to 18 carbon atoms. The degree of alkoxylation of the alcohols is generally between 1 and 20, preferably between 3 and 10. They can be prepared in a known manner by reacting the appropriate alcohols with the appropriate alkylene oxides. Especially suitable are the derivatives of fatty alcohols, although their branched-chain isomers, in particular what are known as oxo alcohols, can also be used to prepare usable alkoxylates. Accordingly usable are the alkoxylates, in particular the ethoxylates, of primary alcohols with linear radicals, especially dodecyl, tetradecyl, hexadecyl or octadecyl radicals, and mixtures thereof. Also usable are corresponding alkoxylation products of alkylamines, vicinal diols and carboxamides which correspond to the alcohols mentioned with regard to the alkyl moiety. Also useful are the ethylene oxide and/or propylene oxide insertion products of fatty acid alkyl esters, as can be prepared by the process specified in the international patent application WO 90/13533, and also fatty acid polyhydroxy amides, as can be prepared by the processes of the American patents U.S. Pat. Nos. 1,985,424, 2,016,962 and 2,703,798 and of the international patent application WO 92/06984. Alkylpolyglycosides which are suitable for incorporation into the inventive compositions are compounds of the general formula $(G)_n$-$OR^{12}$ in which $R^{12}$ is an alkyl or alkenyl radical having from 8 to 22 carbon atoms, G is a glycose unit and n is from 1 to 10. Such compounds and their preparation are described, for example, in the European patent applications EP 92 355, EP 301 298, EP 357 969 and EP 362 671, or the American patent U.S. Pat. No. 3,547,828. The glycoside component $(G)_n$ is oligo- or polymers composed of naturally occurring aldose or ketose monomers, which include in particular glucose, mannose, fructose, galactose, talose, gulose, altrose, allose, idose, ribose, arabinose, xylose and lyxose. The oligomers consisting of such glycosidically linked monomers are characterized, apart from by the type of sugars present therein, by the number thereof, known as the degree of oligomerization. The degree of oligomerization n, as a parameter to be determined analytically, generally assumes fractional numerical values; it is from 1 to 10, and below a value of 1.5 in the case of the glycosides used with preference, in particular between 1.2 and 1.4. Owing to the good availability, a preferred monomer unit is glucose. The alkyl or alkenyl moiety $R^{12}$ of the glycosides preferably likewise stems from readily obtainable derivatives of renewable raw materials, in particular from fatty alcohols, although the branched-chain isomers, in particular oxo alcohols, can also be used to prepare usable glycosides. Accordingly usable are in particular the primary alcohols having linear octyl, decyl, dodecyl, tetradecyl, hexadecyl or octadecyl radicals and mixtures thereof. Particularly preferred alkylglycosides contain a coconut fatty alkyl radical, i.e. mixtures having substantially $R^{12}$=dodecyl and $R^{12}$=tetradecyl.

Non-ionic surfactant is present in compositions which comprise a soil release active ingredient used in accordance with the invention, compositions which are used in accordance with the invention or compositions which are used in the process according to the invention preferably in amounts of from 1% by weight to 30% by weight, in particular from 1% by weight to 25% by weight, amounts in the upper part of this range being encountered mainly in liquid laundry detergents and particulate laundry detergents preferentially containing somewhat smaller amounts of up to 5% by weight.

Instead of this or in addition, the compositions may comprise further surfactants, preferably sulfate- or sulfonate-type synthetic anionic surfactants, for example alkylbenzenesulfonates, in amounts of preferably not more than 20% by weight, in particular from 0.1% by weight to 18% by weight, based in each case on overall composition. Synthetic anionic surfactants particularly suitable for use in such compositions are the alkyl and/or alkenyl sulfates having from 8 to 22 carbon atoms, which bear an alkali metal, ammonium or alkyl- or hydroxyalkyl-substituted ammonium ion as a countercation. Preference is given to the derivatives of fatty alcohols having in particular from 12 to 18 carbon atoms and their branched-chain analogs, known as the oxo alcohols. The alkyl and alkenyl sulfates can be prepared in a known manner by reaction of the corresponding alcohol component with a customary sulfation reagent, in particular sulfur trioxide or chlorosulfonic acid, and subsequent neutralization with alkali metal, ammonium or alkyl- or hydroxyalkyl-substituted ammonium bases. The usable sulfate-type surfactants also include the sulfated alkoxylation products of the alcohols mentioned, known as ether sulfates. Such ether sulfates contain preferably from 2 to 30, in particular from 4 to 10, ethylene glycol groups per molecule. The suitable sulfonate-type anionic surfactants include the $\alpha$-sulfo esters obtainable by reaction of fatty acid esters with sulfur trioxide and subsequent neutralization, in particular the sulfonation products derived from fatty acids having from 8 to 22 carbon atoms, preferably from 12 to 18 carbon atoms, and linear alcohols having from 1 to 6 carbon atoms, preferably from 1 to 4 carbon atoms, and also the sulfo fatty acids arising from these by hydrolysis in a formal sense.

Useful further optional surfactant ingredients include soaps, suitable soaps being saturated fatty acid soaps such as the salts of lauric acid, myristic acid, palmitic acid or stearic acid, and also soaps derived from natural fatty acid mixtures, for example coconut, palm kernel or tallow fatty acids. In particular, preference is given to soap mixtures which are composed of from 50% by weight to 100% by weight of saturated $C_{12}$-$C_{18}$ fatty acid soaps and up to 50% by weight of oleic acid soap. Soap is present preferably in amounts of from 0.1% by weight to 5% by weight. Especially in liquid compositions which comprise a polymer used in accordance with the invention, higher amounts of soap of generally up to 20% by weight may, however, also be present.

If desired, the compositions may also comprise betaines and/or cationic surfactants which, if present, are used preferably in amounts of from 0.5% by weight to 7% by weight. Among these, the ester quats discussed below are particularly preferred.

In addition to the percarbonate, the compositions preferably comprise a compound which eliminates an organic percarboxylic acid under perhydrolysis conditions (i.e. what is known as a bleach activator) and/or an already formed organic percarboxylic acid, in particular in amounts of from 0.5% by weight to 6% by weight. The optionally present component of the bleach activators comprises the customarily used N- or O-acyl compounds, for example polyacylated alkylenediamines, in particular tetraacetylethylenediamine, acylated glycolurils, in particular tetraacetylglycoluril, N-acylated hydantoins, hydrazides, triazoles, urazoles, diketopiperazines, sulfurylamides and cyanurates, and also carboxylic anhydrides, in particular phthalic anhydride, carboxylic esters, in particular sodium isononanoylphenolsulfonate, and acylated sugar derivatives, in particular pentaacetylglucose, and also cationic nitrile derivatives such as trimethylammonioacetonitrile salts. To prevent interaction with the per compounds in the course of storage, the bleach activators may have been coated in a known manner with coating substances or granulated, in which case particular preference is given to tetraacetylethylenediamine which has been granulated with the aid of carboxymethylcellulose and has average particle sizes of from 0.01 mm to 0.8 mm, as can be prepared, for example, by the process described in the European patent EP 37 026, granulated 1,5-diacetyl-2,4-dioxohexahydro-1,3,5-triazine, as can be prepared by the process described in the German patent DD 255 884, and/or trialkylammonioacetonitrile formulated in particulate form by the processes described in the international patent applications WO 00/50553, WO 00/50556, WO 02/12425, WO 02/12426 or WO 02/26927. Laundry detergents and cleaning compositions comprise such bleach activators preferably in amounts of up to 8% by weight, in particular from 2% by weight to 6% by weight, based in each case on overall composition.

In addition, the compositions may comprise further constituents customary in laundry detergents and cleaning compositions. These optional constituents include in particular enzymes, enzyme stabilizers, foam inhibitors, for example organopolysiloxanes or paraffins, solvents, and optical brighteners, for example stilbenedisulfonic acid derivatives. Compositions which comprise a cellulose derivative used in accordance with the invention preferably contain up to 1% by weight, in particular from 0.01% by weight to 0.5% by weight, of optical brighteners, in particular compounds from the class of the substituted 4,4'-bis(2,4,6-triamino-s-triazinyl)stilbene-2,2'-disulfonic acids, and up to 2% by weight, in particular from 0.1% by weight to 1% by weight, of foam inhibitors, the proportions by weight specified being based in each case on overall composition.

Solvents which are used in particular in liquid compositions are, in addition to water, preferably those which are water-miscible. These include the lower alcohols, for example ethanol, propanol, isopropanol and the isomeric butanols, glycerol, lower glycols, for example ethylene glycol and propylene glycol, and the ethers which can be derived from the compound classes mentioned. In such liquid compositions, the cellulose derivatives used in accordance with the invention are generally in dissolved or suspended form.

Optionally present enzymes are preferably selected from the group comprising protease, amylase, lipase, cellulase, hemicellulase, oxidase, peroxidase or mixtures thereof. The primary use for enzymes is protease obtained from microorganisms such as bacteria or fungi. It can be obtained from suitable microorganisms in a known manner by fermentation processes, which are described, for example, in the German laid-open specifications DE 19 40 488, DE 20 44 161, DE 21 01 803 and DE 21 21 397, the American patents U.S. Pat. No. 3,623,957 and U.S. Pat. No. 4,264,738, the European patent application EP 006 638 and the international patent application WO 91/02792. Proteases are commercially available, for example, under the names BLAP®, Savinase®, Esperase®, Maxatase®, Optimase®, Alcalase®, Durazym® or Maxapem®. The usable lipase can be obtained from *Humicola lanuginosa*, as described, for example, in the European patent applications EP 258 068, EP 305 216 and EP 341 947, from *Bacillus* species, as described, for example, in the international patent application WO 91/16422 or the European patent application EP 384 717, from *Pseudomonas* species, as described, for example, in the European patent applications EP 468 102, EP 385 401, EP 375 102, EP 334 462, EP 331 376, EP 330 641, EP 214 761, EP 218 272 or EP 204 284 or the international patent application WO 90/10695, from *Fusarium* species, as described, for example, in the European patent application EP 130 064, from *Rhizopus* species, as described, for example, in the European patent application EP 117 553 or from *Aspergillus* species, as described, for example, in the European patent application EP 167 309. Suitable lipases are commercially available, for example, under the names Lipolase®, Lipozym®, Lipomax®, Lipex®, Amano® lipase, Toyo-Jozo® lipase, Meito® lipase and Diosynth® lipase. Suitable amylases are commercially available, for example, under the names Maxamyl®, Termamyl®, Duramyl® and Purafect® OxAm. The usable cellulase may be an enzyme obtainable from bacteria or fungi which has a pH optimum preferably in the weakly acidic to weakly alkaline range of from 6 to 9.5. Such cellulases are known, for example, from the German laid-open specifications DE 31 17 250, DE 32 07 825, DE 32 07 847, DE 33 22 950 or the European patent applications EP 265 832, EP 269 977, EP 270 974, EP 273 125 and EP 339 550, and the international patent applications WO 95/02675 and WO 97/14804, and are commercially available under the names Celluzyme®, Carezyme® and Ecostone®.

The customary enzyme stabilizers optionally present, especially in liquid compositions, include amino alcohols, for example mono-, di-, triethanol- and -propanolamine and mixtures thereof, lower carboxylic acids, as known, for example, from the European patent applications EP 376 705 and EP 378 261, boric acid or alkali metal borates, boric acid-carboxylic acid combinations, as known, for example, from the European patent application EP 451 921, boric esters, as known, for example, from the international patent application WO 93/11215 or the European patent application EP 511 456, boronic acid derivatives, as known, for example, from the European patent application EP 583 536, calcium salts, for example the calcium-formic acid combination known from the European patent EP 28 865, magnesium salts, as known, for example, from the European patent application EP 378 262 and/or sulfur-containing reducing agents, as known, for example, from the European patent applications EP 080 748 or EP 080 223.

The suitable foam inhibitors include long-chain soaps, in particular behenic soaps, fatty acid amides, paraffins, waxes, microcrystalline waxes, organopolysiloxanes and mixtures thereof, which may additionally comprise microfine, optionally silanized or otherwise hydrophobized silica. For use in particulate compositions, such foam inhibiters are preferably bound to granular, water-soluble carrier substances, as described, for example, in the German laid-open specification DE 34 36 194, the European patent applications EP 262 588, EP 301 414, EP 309 931 or the European patent EP 150 386.

It is also possible to use the combination of said cotton-active soil release-capable cellulose derivative with a polyester-active soil release-capable polymer composed of a dicarboxylic acid and an optionally polymeric diol to enhance the cleaning performance in the washing of textiles. In the context of inventive compositions and of the process according to the invention, combinations of said cotton-active soil release-capable cellulose derivative with a polyester-active soil release-capable polymer are also possible.

The soil release-capable polymers which are known to be polyester-active and can be used in addition to the cellulose derivative essential to the invention include copolyesters of dicarboxylic acids, for example adipic acid, phthalic acid or terephthalic acid, diols, for example ethylene glycol or propylene glycol, and polydiols, for example polyethylene glycol or polypropylene glycol. The soil release-capable polyesters used with preference include those compounds which are obtainable in a formal sense by esterification of two monomer units, the first monomer being a dicarboxylic acid HOOC-Ph-COOH and the second monomer a diol $HO—(CHR^{11}—)_aOH$ which may also be present as a polymeric diol $H—(O—(CHR_{11}—)_a)_bOH$. In this formula, Ph is an o-, m- or p-phenylene radical which may bear from 1 to 4 substituents selected from alkyl radicals having from 1 to 22 carbon atoms, sulfonic acid groups, carboxyl groups and mixtures thereof, $R^{11}$ is hydrogen, an alkyl radical having from 1 to 22 carbon atoms and mixtures thereof, a is from 2 to 6 and b is from 1 to 300. In the polyesters obtainable therefrom, preferably both monomer diol units $—O—(CHR_{11}—)_aO—$ and polymer diol units $—(O—(CHR^{11}—)_a)_bO—$ are present. The molar ratio of monomer diol units to polymer diol units is preferably from 100:1 to 1:100, in particular from 10:1 to 1:10. In the polymer diol units, the degree of polymerization b is preferably in the range from 4 to 200, in particular from 12 to 140. The molecular weight or the mean molecular weight or the maximum of the molecular weight distribution of preferred soil release-capable polyesters is in the range from 250 to 100 000, in particular from 500 to 50 000. The parent acid of the Ph radical is preferably selected from terephthalic acid, isophthalic acid, phthalic acid, trimellitic acid, mellitic acid, the isomers of sulfophthalic acid, sulfoisophthalic acid and sulfoterephthalic acid, and mixtures thereof. When the acid groups are not part of the ester bonds in the polymer, they are preferably present in salt form, in particular as the alkali metal or ammonium salt. Among these, particular preference is given to the sodium and potassium salts. If desired, instead of the monomer HOOC-Ph-COOH small fractions, in particular not more than 10 mol % based on the proportion of Ph as defined above, of other acids which have at least two carboxyl groups may be present in the soil release-capable polyester. These include, for example, alkylene- and alkenylenedicarboxylic acids such as malonic acid, succinic acid, fumaric acid, maleic acid, glutaric acid, adipic acid, pimelic acid, suberic acid, azelaic acid and sebacic acid. The preferred diols $HO—(CHR^{11}—)_aOH$ include those in which $R^{11}$ is hydrogen and a is from 2 to 6, and those in which a is 2 and $R^{11}$ is selected from hydrogen and the alkyl radicals having from 1 to 10, in particular from 1 to 3, carbon atoms. Among the latter diols, particular preference is given to those of the formula $HO—CH_2—CHR^{11}—OH$ in which $R^{11}$ is as defined above. The examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. Among the polymeric diols, particular preference is given to polyethylene glycol having a mean molar mass in the range of from 1000 to 6000.

If desired, the polyesters having the composition as described above may also be end group-capped, in which case useful end groups are alkyl groups having from 1 to 22 carbon atoms and esters of monocarboxylic acids. The parent acids of the end groups bonded by means of ester bonds may be alkyl-, alkenyl- and arylmonocarboxylic acids having from 5 to 32 carbon atoms, in particular from 5 to 18 carbon atoms. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, eleostearic acid, arachic acid, gadoleic acid, arachidonic acid, behenic acid, erucic acid, brassidic acid, clupanodonic acid, lignoceric acid, cerotic acid, melissic acid, benzoic acid which may bear from 1 to 5 substituents having a total of up to 25 carbon atoms, in particular from 1 to 12 carbon atoms, for example tert-butylbenzoic acid. The parent acids of the end groups may also be hydroxymonocarboxylic acids, having from 5 to 22 carbon atoms, which include, for example, hydroxyvaleric acid, hydroxycaproic acid, ricinoleic acid, their hydrogenation product hydroxystearic acid, and also o-, m- and p-hydroxybenzoic acid. The hydroxymonocarboxylic acids may in turn be joined together by means of their hydroxyl group and their carboxyl group and thus be present more than once in one end group. The number of hydroxymonocarboxylic acid units per end group, i.e. their degree of oligomerization, is preferably in the range from 1 to 50, in particular from 1 to 10. In a preferred embodiment of the invention, polymers composed of ethylene terephthalate and polyethylene oxide terephthalate in which the polyethylene glycol units have molar masses of from 750 to 5000 and the molar ratio of ethylene terephthalate to polyethylene oxide terephthalate is from 50:50 to 90:10 are used in combination with the cellulose derivatives.

The soil release-capable polymers are preferably water-soluble, the term "water-soluble" meaning a solubility of at least 0.01 g, preferably at least 0.1 g, of the polymer per liter of water at room temperature and pH 8. However, polymers used with preference have a solubility of at least 1 g per liter, in particular at least 10 g per liter, under these conditions.

Preferred laundry after-treatment compositions have, as a laundry-softening active ingredient, an ester quat, i.e. a quaternized ester composed of carboxylic acid and amino alcohol. These are known substances which can be obtained by the relevant methods of preparative organic chemistry. In this context, reference is made to the international patent application WO 91/01295, by which triethanolamine is esterified partly with fatty acids in the presence of hypophosphorous acid, air is passed through and the mixture is subsequently quaternized with dimethyl sulfate or ethylene oxide. Moreover, the German patent DE 43 08 794 discloses a process for preparing solid ester quats in which the quaternization of triethanolamine esters is carried out in the presence of suitable dispersants, preferably fatty alcohols. Reviews on this theme have been published, for example, by R. Puchta et al. in Tens. Surf. Det., 30, 186 (1993), M. Brock in Tens. Surf. Det. 30, 394 (1993), R. Lagerman et al. in J. Am. Oil. Chem. Soc., 71, 97 (1994) and 1. Shapiro in Cosm. Toil. 109, 77 (1994).

Ester quats preferred in the compositions are quaternized fatty acid triethanolamine ester salts which follow the formula (I)

(I)

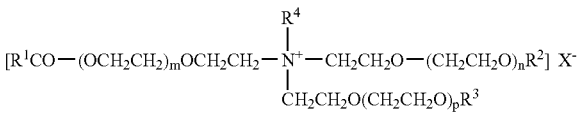

in which $R^1CO$ is an acyl radical having from 6 to 22 carbon atoms, $R^2$ and $R^3$ are each independently hydrogen or $R^1CO$, $R^4$ is an alkyl radical having from 1 to 4 carbon atoms or a $(CH_2CH_2O)_qH$ group, m, n and p in total are 0 or from 1 to 12, q is from 1 to 12 and X is a charge-balancing anion such as halide, alkylsulfate or alkylphosphate. Typical examples of ester quats which may find use in the context of the invention are products based on caproic acid, caprylic acid, capric acid, lauric acid, myristic acid, palmitic acid, isostearic acid, stearic acid, oleic acid, elaidic acid, arachic acid, behenic acid and erucic acid, and their technical-grade mixtures, as are obtained, for example, in the pressure cleavage of natural fats and oils. Preference is given to using technical-grade $C_{12/18}$ coconut fatty acids and in particular partly hydrogenated $C_{16/18}$ tallow or palm fatty acids, and also elaidic acid-rich $C_{16/18}$ fatty acid cuts. To prepare the quaternized esters, the fatty acids and the triethanolamine can be used generally in the molar ratio of from 1.1:1 to 3:1. With regard to the performance properties of the ester quats, a use ratio of from 1.2:1 to 2.2:1, preferably from 1.5:1 to 1.9:1, has been found to be particularly advantageous. The ester quats used with preference are technical-grade mixtures of mono-, di- and triesters having an average degree of esterification of from 1.5 to 1.9, and derive from technical-grade $C_{16/18}$ tallow or palm fatty acid (iodine number from 0 to 40).

Quaternized fatty acid triethanolamine ester salts of the formula (I) in which $R^1CO$ is an acyl radical having from 16 to 18 carbon atoms, $R^2$ is $R^1CO$, $R^3$ is hydrogen, $R^4$ is a methyl group, m, n and p are each 0 and X is methylsulfate have been found to be particularly advantageous.

In addition to the quaternized carboxylic acid triethanolamine ester salts, useful ester quats are also quaternized ester salts of carboxylic acids with diethanolalkylamines of the formula (II)

(II)

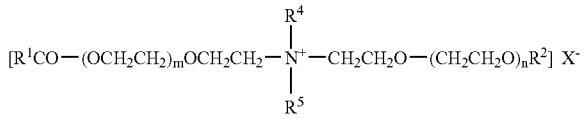

in which $R^1CO$ is an acyl radical having from 6 to 22 carbon atoms, $R^2$ is hydrogen or $R^1CO$, $R^4$ and $R^5$ are each independently alkyl radicals having from 1 to 4 carbon atoms, m and n in total are 0 or from 1 to 12, and X is a charge-balancing anion such as halide, alkylsulfate or alkylphosphate.

As a further group of suitable ester quats, mention should finally be made of the quaternized ester salts of carboxylic acids with 1,2-dihydroxypropyldialkylamines of the formula (III), (III)

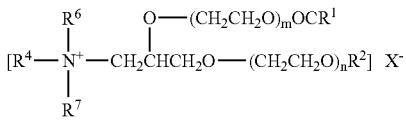

in which $R^1CO$ is an acyl radical having from 6 to 22 carbon atoms, $R^2$ is hydrogen or $R^1CO$, $R^4$, $R^6$ and $R^7$ are each independently alkyl radicals having from 1 to 4 carbon atoms, m and n in total are 0 or from 1 to 12, and X is a charge-balancing anion such as halide, alkylsulfate or alkylphosphate.

With regard to the selection of the preferred fatty acids and of the optimal degree of esterification, the remarks made by way of example for (I) also apply mutatis mutandis to the ester quats of the formulae (II) and (III). Typically, the ester quats are commercially available in the form of 50 to 90 percent by weight alcoholic solutions which can also be diluted with water without any problem, and ethanol, propanol and isopropanol are the customary alcoholic solvents.

Ester quats are used preferably in amounts of from 5% by weight to 25% by weight, in particular from 8% by weight to 20% by weight, based in each case on overall laundry after-treatment composition. If desired, the laundry after-treatment compositions used in accordance with the invention may additionally comprise above-detailed laundry detergent ingredients, as long as they do not interact adversely with the ester quat in an unacceptable manner. They are preferably liquid, water-containing compositions.

Solid compositions are preferably prepared in such a way that a particle which comprises soil release-capable cellulose derivative is mixed with further laundry detergent ingredients present in solid form, in particular the constituents of the water-soluble builder block. To prepare the particle which comprises the soil release-capable cellulose derivative, preference is given to using a spray-drying step. Alternatively, it is also possible to use a compacting compounding step to prepare this particle and optionally also to prepare the finished composition.

EXAMPLE

| A laundry detergent (V1) comprising | |
|---|---|
| ABS | 12 parts by weight |
| C12/14 fatty alcohol* 7 EO | 3 parts by weight |
| TAED | 2.5 parts by weight |
| Percarbonate | 13 parts by weight |
| Sodium carbonate | 20 parts by weight |
| Sodium hydrogencarbonate | 5 parts by weight |
| Sokalan ® CP 5[a)] | 3 parts by weight |
| Sodium sulfate | 27 parts by weight |
| Tinopal ® DMS-X[b)] | 0.2 part by weight |

a) Polymeric polycarboxylate, manufacturer: BASF AG
b) Optical brightener, manufacturer: Ciba was admixed with 0.5 part by weight of methylhydroxyethylcellulose (DS 1.89; MS 0.15; mean molar mass 100 000) (W1). Fabric of pure cotton, finished cotton and 50/50 polyester/cotton mixed fabric were treated as follows:
Washing machine: Miele W 918 Novotronic®
Primary wash: Standard program, single-liquor process
Wash temperature: 40° C.
Determination: 5-fold
Liquor volume: 18 l
Water hardness: 16° German hardness
Ballast: 3.5 kg of clean laundry The unstained fabrics were washed three times under the above-specified conditions with the laundry detergent to be tested in each case and dried after each wash. After the threefold prewash, the fabrics were stained by hand with the following standardized stains:
0.10 g of lipstick
0.10 g of black shoe polish
0.10 g of dust/sebum The stained fabrics were measured with a Minolta CR 200 and subsequently aged at RT for 7 days. Afterward, the stained fabrics were tacked onto towels and washed under the above-specified conditions.

The fabrics were dried and measured again with a Minolta CR 200. The following wash results were obtained (dde values):

TABLE 1

| | pure cotton | | |
|---|---|---|---|
| | Lipstick | Black shoe polish | Dust/sebum |
| V1 | 75.1 | 30.5 | 21.9 |
| W1 | 78.5 | 34.7 | 25.4 |

TABLE 2

| | finished cotton | | |
|---|---|---|---|
| | Lipstick | Black shoe polish | Dust/sebum |
| V1 | 76.4 | 55.3 | 47.2 |
| W1 | 81.5 | 58.4 | 50.8 |

TABLE 3

| | cotton/polyester | | |
|---|---|---|---|
| | Lipstick | Black shoe polish | Dust/sebum |
| V1 | 19.9 | 55.1 | 59.6 |
| W1 | 24.0 | 58.3 | 63.8 |

It can be seen that the use of the laundry detergent comprising the cellulose derivative to be used in accordance with the invention gives rise to distinctly better washing performance than the use of the composition lacking the cellulose derivative.

The invention claimed is:

1. A builder-containing laundry detergent or cleaning composition comprising:
(1) alkali metal percarbonate;
(2) a water-soluble builder comprising:
a) from 5% by weight to 35% by weight of either citric acid or an alkali metal citrate in combination with a carbonate mixture comprising an alkali metal carbonate and an alkali metal hydrogen carbonate;
b) from 1% to 5% by weight of alkali metal silicate having a modulus in the range from 1.8 to 2.5;
c) from 0.05% to 1% by weight of phosphonic acid and/or alkali metal phosphonate;
d) from 15% to 35% by weight of alkali metal phosphate;
e) from 1.5% to 5% by weight of polymeric polycarboxylate; and
(3) a soil release-capable cellulose derivative composition comprising a $C_1$ to $C_3$ alkyl cellulose derivative and a $C_2$ to $C_{10}$ hydroxyalkyl cellulose derivative.

2. The composition of claim 1 wherein the mean molar mass of the cellulose derivative is from 10 000 D to 150 000 D.

3. The composition of claim 2 wherein the mean molar mass of the cellulose derivative is from 40 000 D to 120 000 D.

4. The composition of claim 3 wherein the mean molar mass of the cellulose derivative is from 80 000 D to 110 000 D.

5. The composition of claim 1 comprising from 0.1% by weight to 5% by weight of the cellulose derivative.

6. The composition of claim 5 comprising from 0.5% by weight to 2.5% by weight of the cellulose derivative.

7. The composition of claim 1 wherein the amount of alkali metal percarbonate is from 6% by weight to 30% by weight.

8. The composition of claim 7 wherein the amount of alkali metal percarbonate is from 10% by weight to 25% by weight.

9. The composition of claim 1 wherein the alkali metal percarbonate is particulate and has at least two coating layers, an innermost layer comprising at least one hydrate-forming inorganic salt and an outer layer comprising an alkali metal silicate.

10. The composition of claim 1 further comprising a compound which releases an organic percarboxylic acid under perhydrolysis conditions and/or comprises an organic percarboxylic acid, in particular in an amount of from 0.5% by weight to 6% by weight.

11. The composition of claim 1 wherein the amount of the builder is at least 25% by weight.

12. The composition of claim 1 wherein the amount of the builder is from 25% to 55% by weight.

13. The composition of claim 1 wherein the amount of the builder is from 25% by weight to 50% by weight.

14. The composition of claim 1 wherein component a) is comprised of from 15% by weight to 25% by weight of an alkali metal hydrogen carbonate and from 0.05% to 5% by weight of citric acid and/or alkali metal citrate.

15. The composition of claim 14 wherein the amount of citric acid and/or alkali metal citrate is from 0.5% by weight to 2.5% by weight.

16. The composition of claim 1 wherein component a) is comprised of from 5% by weight to 25% by weight of citric acid and/or alkali metal citrate, and from 1% to 5% by weight of an alkali metal carbonate or an alkali metal hydrogen carbonate or a combination of thereof.

17. The composition of claim 1 wherein component a) comprises an alkali metal carbonate and alkali metal hydrogen carbonate in a weight ratio of from 10:1 to 1:1.

18. The composition of claim 1 wherein component c) is a hydroxyalkylphosphonic and/or aminoalkylphosphonic acid and/or the alkali metal salts thereof.

19. The composition of claim 1 wherein alkali metal phosphate is trisodium polyphosphate.

20. The composition of claim 1 wherein the polymeric polycarboxylate is a homo or copolymer of acrylic acid, methacrylic acid and/or maleic acid.

21. A method of cleaning a textile material comprising contacting a textile material with a laundry detergent according to claim 1.

22. A process for producing a solid laundry detergent composition comprising mixing a composition comprised of:

(1) alkali metal percarbonate;

(2) particles of a soil release-capable cellulose derivative composition comprising a $C_1$ to $C_3$ alkyl cellulose derivative and a $C_2$ to $C_{10}$ hydroxyalkyl cellulose derivative;

(3) a water-soluble builder which is comprised of:

a) from 5% by weight to 35% by weight of either citric acid or an alkali metal citrate in combination with a carbonate mixture comprising an alkali metal carbonate and an alkali metal hydrogen carbonate;

b) from 1% to 5% by weight of alkali metal silicate having a modulus in the range from 1.8 to 2.5;

c) from 0.05% to 1% by weight of phosphonic acid and/or alkali metal phosphonate;

d) from 15% to 35% by weight of alkali metal phosphate;

e) from 1.5% to 5% by weight of polymeric polycarboxylate; and (4) a laundry detergent in particulate form.

23. The process of claim 22 wherein the particle which comprises the soil release-capable cellulose derivative is prepared by spray-drying.

24. The process of claim 22 wherein the particle which comprises the soil release-capable cellulose derivative is prepared by using a compacting compounding step.

* * * * *